United States Patent [19]

Robineau et al.

[11] Patent Number: 4,628,155

[45] Date of Patent: Dec. 9, 1986

[54] ELECTROACOUSTIC MOTOR FOR HORNS

[76] Inventors: Philippe Robineau, 51 rue Truffaut, 75017 Paris; Eric Vincenot, 12, rue Léon Giraud, 75019 Paris, both of France

[21] Appl. No.: 662,508

[22] Filed: Oct. 19, 1984

Related U.S. Application Data

[63] Continuation of Ser. No. 397,194, Jul. 12, 1982.

[51] Int. Cl.[4] ..... G10K 13/00

[52] U.S. Cl. ..... 381/156; 181/159

[58] Field of Search ..... 179/115.5 H; 181/152, 181/159, 177, 179, 182, 185, 187, 188, 192

[56] References Cited

U.S. PATENT DOCUMENTS

| | | | |
|---|---|---|---|
| 4,157,741 | 6/1979 | Goldwater | 181/159 |
| 4,181,193 | 1/1980 | Isaac | 181/159 |
| 4,206,831 | 6/1980 | Welch | 181/159 |
| 4,210,223 | 7/1980 | Gillum | 181/159 |

FOREIGN PATENT DOCUMENTS

| | | | |
|---|---|---|---|
| 228102 | 7/1925 | United Kingdom | 181/152 |

*Primary Examiner*—Gene Z. Rubinson
*Assistant Examiner*—L. C. Schroeder
*Attorney, Agent, or Firm*—Charles E. Brown; Charles A. Brown

[57] ABSTRACT

An electroacoustic motor for association with a horn comprising, in combination, a direct radiation speaker including a chassis, the speaker including a movable diaphragm, an acoustic wave transmitting means comprising an output orifice at the end thereof remote from said diaphragm, and passage means in the acoustic wave transmitting means communicating acoustic waves from the diaphragm to the output orifice. The acoustic wave transmitting means is a separate unit which is detachably secured to the speaker chassis by a fluid-tight connection. The acoustic wave transmitting means comprises a hollow truncated conical member of smaller diameter at the output orifice end thereof than at the end thereof contiguous the diaphragm. A phase adjustment element is positioned in the hollow interior of the truncated conical member, the phase adjustment element being in facing relation at one end thereof to the diaphragm and at the opposite end thereof to the output orifice of the truncated conical member.

22 Claims, 4 Drawing Figures

ELECTROACOUSTIC MOTOR FOR HORNS

This is a continuation of application Ser. No. 397,194 filed July 12, 1982.

FIELD OF THE INVENTION

This invention relates to electroacoustic motors or transducers having a movable diaphragm and more precisely to their association with acoustic transformers whose various types are grouped under the general name of horns.

DESCRIPTION OF THE PRIOR ART

Transducers, which are mounted on horns, can be classed in two categories. On the one hand, there are motors specifically intended for this use, which, both in their general design and their various component parts, resort to a technique, a technology and manufacturing processes specific to them: in particular there are those known as compression chamber motors. On the other hand, speakers are also used whose general design does not earmark them basically, if at all, for functioning in combination with horns. Although being able to exhibit certain desirable characteristics in their electroacoustic parameters, they belong by the technique, technology and manufacturing processes used to transducers commonly used in direct radiation, i.e. in which the diaphragm is directly coupled, without a horn, to the target medium.

use of this second category of transducers, which we will group below under the general name of direct radiation speakers, in association with horns, poses a number of technical problems. A major problem arises from the fact that it is generally necessary for the surface of the opening or constituting what is called the throat to exhibit a notably smaller area than that of the diaphragm on the one hand, the presence in front of the diaphragm of a resulting space between the diaphragm and throat tends to cause a drop in the response to high frequencies and, on the other hand, the lack of uniformity of the acoustic paths between the various points on the diaphragm and throat tends to cause phase cancellations that are also prejudicial. To mitigate these problems, devices have been used aimed at optimizing the shape and volume of the chamber located in front of the diaphragm, and in certain cases, at reducing phase differences due to the differences in length of the acoustic paths (phase correction devices). In any case, it is important for a good functioning of the system that the speaker be able to be positioned precisely in relation to the pieces or parts of the system which face the diaphragm, to permit an exact centering, on the one hand, and a precise adjustment of the space between the diaphragm and neck, on the other hand, it being understood that an effort will be made generally to reduce it as much as possible to improve performances. On the other hand, it is necessary to assure a perfect fluid tightness of the entire propagation space to the output of the horn.

SUMMARY OF THE INVENTION

In a general way, it is therefore advisable that the system resulting from the association of a direct radiation speaker with one or more horns be designed as a whole to include devices performing certain technical functions that are essential to the good functioning of the system. In the first place, the system therefor comprises a device making it possible to position the speaker, assuring a precise and easy positioning of the diaphragm in relation to the mechanical pieces or parts of the system which face it and also in relation to the throat, and a speaker fastening device.

On the other hand, a group of devices is provided to delimit the shape, adjust the dimensions and assure fluid tightness of the chamber or, in a general way, the the acoustic wave transmission space between the diaphragm and throat the purposes being to optimize the volume of this chamber, the space necessary for movement of the diaphragm, and to control the propagation paths of the acoustic waves to the throat. Considering the system unit intended to function with the speaker, the invention is characterized in the first place in that delimiting of the placement and the shape of the openings constituting the neck, and the devices intended to perform the various technical functions mentioned above, are made entirely by a group of parts provided to be able to be added and fastened to the speaker to constitute, with it, a single materially independent unit which is called a motor. These added parts by themselves delimit one or more output orifices, connected to the throat and making it possible to collect the acoustic pressure coming from the motor, this orifice or these orifices therefore enable the motor to be connected by a fastening device, provided for this purpose, to one or more horns assuring the major part of the propagation path of the acoustic waves from their emission by the diaphragm to the final target medium.

In the second place, the invention is characterized in that the additional parts intended to constitute the motor, are produced independently of the constituent parts of the direct radiation speaker, and these parts, whether they are incorporated before, at the same time or later, in the operations of assembling the parts of the speaker, are not necessary to obtain a speaker able to function in the direct radiation operating mode.

The unit forming the motor including the speaker can include devices performing technical functions other than those defined above; thus when it is desired to extend the possible utilization zone of direct radiation speakers mounted on horns to frequencies usually reserved for the so-called compression chamber motors and it may become necessary to resort to a phase correction device, the latter can be incorporated of added parts, just like any conduits, as well as ducts, whether flared or not, making it possible to optimize the transition between the neck and output orifice or orifices, and more generally any devices making it possible to improve the performance of a motor made according to the invention or to facilitate its use.

BRIEF DESCRIPTION OF THE DRAWINGS

A nonlimiting embodiment is shown in the accompanying drawings in which.

DESCRIPTION OF THE PREFERRED EMBODIMENT

Figure 1:
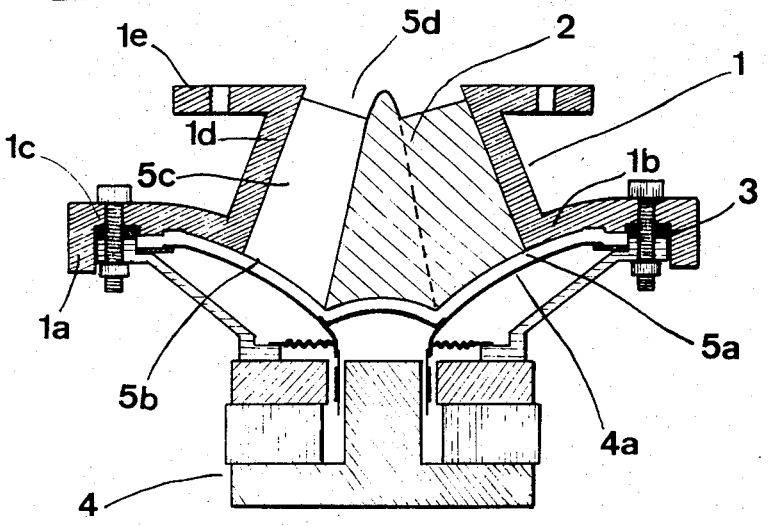
FIG. 1 is a view in section of an electroacoustic motor according to the invention.

According to the invention, there is fitted on a direct radiation speaker 4 a part 1 performing the following functions:

by its lip 1*a* fitting the shape of the speaker chassis, it assures precise centering of the speaker in the plane at right angles to the axis the speaker;

by its sealing plane 1*c* receiving a fluid tightness seal 3, also functioning as a spacer, it makes possible the fastening of the speaker by bolts and its orientation in a predetermined fastening plane, and the adjustment of the dimensions of the compression chamber 5*a* of the speaker;

by its part 1*b* fitting the shape of the speaker chassis and the peripheral zone of the speaker diaphragm 4*a*, it performs the functions of controlling the volume of the compression chamber 5*a* and of guiding the paths of propagation of the acoustic waves;

by its truncated cone 1*d* it assures the positioning in the three dimensions of phase adjustment part 2;

by its fastening plate 1*e* comprising a sealing plane and fastening holes, it makes possible the final assembly of the unit on a horn.

According to another characteristic of the invention, a phase adjustment element 2, fastening on the inside of part 1*d* of part 1, contributes, by the shape of its lower part facing diaphragm (4*a*), to assuring control of the shape of the volume of the compression chamber 5*a* and guiding of the waves to the throat, which here consists of several openings 5*b* extended by channels 5*c* flaring toward in the plane of part 1*e* to constitute output orifice 5*d*. Parts 1 and 2 can be easily made by casting, molding or injection of metal or plastic, element 2 being able to be one piece with part 1.

The advantages brought by the invention are multiple and relate at the same time to technical, practical and economic fields. They flow essentially from the fact that in the invention, contrary to prior embodiments, the totality of the technical functions set forth above (positioning, centering and fastening of the speaker, adjustment and delimiting of the dimensions and shape of the chamber made in front of the diaghragm, fluid tightness, making of holes forming the throat), are assured by parts added to the direct radiation speaker and with it constituting a compact unit materially independently of the horn. In the totality of the prior embodiments, actually only one part of these functions is performed by the parts added to the speaker when such parts exist. The most current process prior art consisting simply in the speaker being applied and fastened directly, in its original shape, to the horn.

The direct consequence of this characteristic of the invention is that, as with motors of the compression chamber category, the connection of the motor, made according to the principles of the invention, to the horn per se is made at a location where this connection does not exhibit any critical aspect. This constitutes one of the remarkable advantages brought by the invention, comprising both technical and practical aspects. Actually, according to the invention, control of the positioning of the speaker, which requires a great precision, and that of fluid tightness are facilitated and can be performed definitively during the production stage, whereas with the conventional procedures the magnitude of these problems is increased by the fact that during disassembly and reassembly of the speaker are systematically encountered, operations frequently necessary with the context of testing, development, production, maintenance and aftersales service.

Another advantage of the invention is that, by providing a standardized fitting plate, it is possible to couple the same motor to different types of horns and vice versa to use the same horn in combination with different motors.

Figure 2:
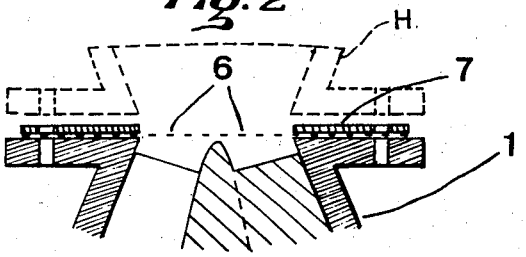
FIG. 2 is a partial view of the upper part of FIG. 1.
Figure 4:
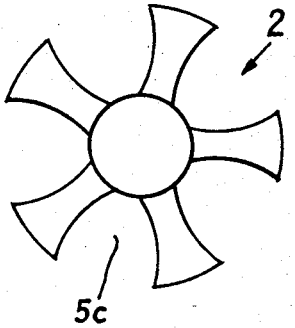
FIG. 4 is a bottom view of the phase adjustment element 2 of FIG. 1.

Another advantage of the present invention is that it makes it possible easily to incorporate into the system a device (grill or screen) for protecting the diaphragm from foreign bodies, which is very difficult with prior art constructions. Actually, this device can simply be placed on the fitting plate, as shown in accompanying FIG. 2. This figure represents the upper part of the unit consisting of the embodiment of FIG. 1, to which a protective grill 6 has been added by being placed on the part of part 1 forming fitting plate 1*e*, and a seal 7 assuring fluid tightness during later mounting of the unit on the horn H.

The list of advantages of the invention given above is not exhaustive; in particular, other advantages result from the possibility the parts added to the speaker to perform functions other than those set forth in defining the invention. From this viewpoint, addition to the motor of accessory parts aimed at modifying certain characteristics of the latter or any improvement of performances is perfectly compatible with the invention and any embodiment conforming to the invention would not in any case by going outside the its scope.

Figure 3:
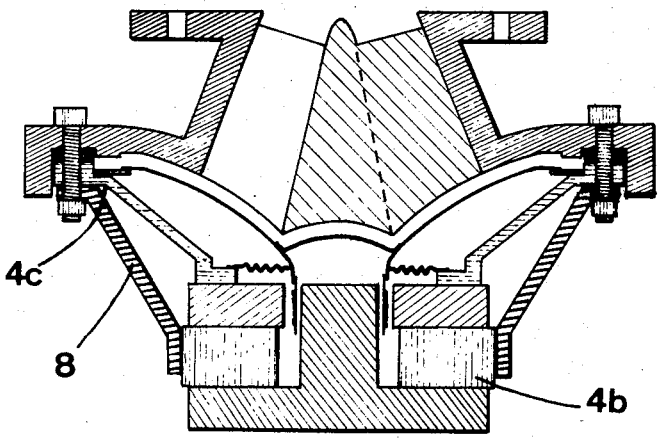
FIG. 3 is a view in section of a modified arrangement.

Thus, in certain cases it can be advantageous to add to the speaker, besides the parts used for the functions defined for the invention, a part that is fastened to the back part of the speaker and serving to enclose a volume behind the diaphgram: this part, acting in the same way as the other parts forming the motor, therefore preserves the characteristics of the invention and all the advantages flowing therefrom. Accompanying FIG. 3 represents the unit consisting of the embodiment of FIG. 1, to which has been added a cap 8 having the function defined above. This part is fastened in a fluid-tight manner to the speaker by being put in contact, on the one hand, with peripheral part 4*c* of the speaker chassis and, on the other hand, with the periphery of magnet 4*b*.

We claim:

1. An acoustic adaptor for acoustically and mechanically coupling a selected horn to a direct radiation cone type speaker including a diaphragm flaring towards and attached to a rim of a speaker chassis, said acoustic adaptor comprising:

means for center said adaptor with respect to the axis of the speaker;

sealing means defining a fluid-tight connection between the speaker chassis rim and said adaptor;

means for securing the speaker chassis to said adaptor;

a tapered annular portion of configuration complementary to an outer annular zone of the diaphragm for defining with the outer annular zone part of a compression chamber;

a projecting tubular portion extending from the radially inner periphery of said tapered annular portion and having an input orifice defined within said tapered annular portion and an output orifice at an end remote from said tapered annular portion for communication with a horn; and means at the end of said tubular portion adjacent said output orifice for mounting said adaptor to the horn.

2. The acoustic adaptor according to claim 1, wherein said means for centering said adaptor with respect to the speaker comprises a depending lip at the outer periphery of said tapered portion cooperable with the rim of the speaker chassis.

3. The acoustic adaptor according to claim 1, together with clamping means comprising threaded fasteners adapted to extend through holes, in register, proximate the outer periphery of said tapered annular portion and in the speaker chassis rim, respectively.

4. The acoustic adaptor according to claim 1, wherein said sealing means permits limited adjustments of the relative positions of said adaptor and the speaker chassis.

5. The acoustic adaptor according to claim 1, wherein said sealing means is accommodated in a recess adapted to face a flat sealing surface on the speaker chassis rim.

6. The acoustic adaptor according to claim 5, wherein said clamping means extends through said recess accommodating said sealing means.

7. The acoustic adaptor according to claim 1, wherein said tubular portion is frustoconical and tapers away from the inner periphery of said tapered annular portion, said frustoconical tubular portion being adapted to accommodate a phasing plug with a plurality of channels flaring from said input orifice toward said output orifice.

8. The acoustic adaptor according to claim 1, wherein said means for securing said adaptor to the horn includes a radially outwardly extending flange at the end of said tubular portion remote from said tapered annular portion.

9. The acoustic adaptor according to claim 8, wherein a suitable seal is provided on said flange for providing fluid-tightness between said adaptor and the horn.

10. The acoustic adaptor according to claim 8, wherein said means for securing said adaptor to the horn includes holes through said flange.

11. An acoustic motor comprising a direct radiation cone type speaker including a chassis having a rim, a diaphragm having a central portion and an annular portion flaring outwardly from said central portion and attached at its periphery to said rim; an acoustic adaptor for acoustically and mechanically adapting said cone type speaker to a selected horn, said acoustic adaptor comprising means for centering said adaptor with respect to the axis of said speaker, sealing means defining a fluid-tight connection at the outer periphery of said diaphragm, means for clamping said adaptor to said speaker chassis rim, a tapered annular portion of complementary configuration to and in overlying matable relation with respect to an annular zone of the outer surface of said speaker diaphragm, the distance between said outer annular portion of said diaphragm and said tapered annular zone of said adaptor being enough to allow the excursion of said diaphragm, a compression chamber being outwardly limited by said sealing means and defined partly in the space between said tapered annular portion of said adaptor and said annular zone of said speaker diaphragm, a projecting tubular portion extending from the radially inner periphery of said tapered annular portion for guiding sound waves and having an input orifice within said tapered annular portion and an output orifice at an end remote from said tapered annular portion for communication with a horn, and clamping means at the end of said tubular portion remote adjacent said output orifice for securing said adaptor to the horn.

12. The acoustic motor according to claim 11, wherein said means for centering said adaptor with respect to the speaker comprises a depending lip at the outer periphery of said tapered portion cooperating with said rim of the speaker chassis.

13. The acoustic motor according to claim 11, wherein said clamping means comprises threaded fasteners adapted to extend through holes, in register, in said adaptor proximate the outer periphery of said tapered annular portion and in said speaker chassis rim, respectively.

14. The acoustic motor according to claim 11, wherein said sealing means permits limited adjustments of the position of said adaptor relative to said speaker chassis.

15. The acoustic motor according to claim 11, wherein said sealing means is accommodated in a recess adapted to face a flat sealing surface on said speaker chassis rim.

16. The acoustic motor according to claim 14, wherein said clamping means extends through said recess accommodating said sealing means.

17. The acoustic motor according to claim 1, wherein said tubular portion is frustoconical and tapers away from the inner periphery of said tapered annular portion, said frustoconical tubular portion accommodates a phasing plug with a plurality of channels flaring from said input orifice to said output orifice.

18. The acoustic motor according to claim 11, wherein said means for securing said adaptor to the horn includes a radially outwardly extending flange at the end of said tubular portion remote from said tapered annular portion.

19. The acoustic motor according to claim 18, wherein a suitable seal is provided on said flange for providing fluid-tightness between said adaptor and the horn.

20. The acoustic motor according to claim 18, wherein said means for securing said adaptor to the horn includes holes through said flange.

21. The acoustic motor according to claim 1, further comprising a cap adapted to be fixed to the rear of said speaker for defining a closed space behind said speaker diaphragm.

22. An acoustic adaptor unit for acoustically and mechanically coupling a selected horn to a direct radiation cone type speaker including a diaphragm flaring towards and attached to a rim of a speaker chassis, said acoustic adaptor unit comprising: an acoustic adaptor and a phasing plug; means for centering said adaptor with respect to the axis of the speaker; means for defining a fluid-tight connection at the outer periphery of the diaphragm; said adaptor including a tapered annular portion of configuration complementary to an annular zone of the outer surface of the diaphragm; an outwardly tapering frustoconical portion extending from the radially inner periphery of said tapered annular portion and having an output orifice at an end remote from said tapered annular portion for communication with a horn; and means at the end of said tubular portion adjacent said output orifice for securing said adaptor to the horn, said phasing plug being accommodated inside said frustoconical portion of said adaptor, the inner surfaces of said adaptor and said phasing plug being complementary to the central and surrounding annular area of the diaphragm for defining a compression chamber therewith.

* * * * *